United States Patent [19]

Saito

[11] 4,079,714

[45] Mar. 21, 1978

[54] AIR-FUEL MIXTURE SUPPLY DEVICE OF INTERNAL COMBUSTION ENGINE

[75] Inventor: Masaaki Saito, Yokosuka, Japan

[73] Assignee: Nissan Motor Company, Ltd., Japan

[21] Appl. No.: 672,047

[22] Filed: Mar. 30, 1976

[30] Foreign Application Priority Data

Mar. 31, 1975 Japan ..... 50/38929
Apr. 8, 1975 Japan ..... 50/41885

[51] Int. Cl.[2] ..... F02M 11/00; F02D 33/00; F02M 7/00

[52] U.S. Cl. ..... 123/119 EC; 123/119 E; 123/119 EE; 123/198 E; 261/89; 261/DIG. 48

[58] Field of Search ..... 123/119 E, 119 EE, 119 EC, 123/198 E; 261/DIG. 48, 89

[56] References Cited

U.S. PATENT DOCUMENTS

| | | | |
|---|---|---|---|
| 1,268,299 | 6/1918 | Thompson | 261/89 |
| 1,939,302 | 12/1933 | Heaney | 123/198 E |
| 2,211,552 | 8/1940 | Bernstein | 261/89 |
| 3,906,910 | 9/1975 | Szlaga | 123/97 B |

FOREIGN PATENT DOCUMENTS

| | | | |
|---|---|---|---|
| 2,444,695 | 9/1974 | Germany | 123/119 EC |
| 45-17485 | 6/1970 | Japan | 261/DIG. 48 |
| 508,582 | 7/1939 | United Kingdom | 123/198 E |

*Primary Examiner*—Wendell E. Burns

[57] ABSTRACT

The fuel passing through the main discharge nozzle of a carburetor is positively vibrated or be caused to pulsate to supply well atomized fuel into the air-fuel mixture induction passage of the carburetor in order to improve the combustion condition within the combustion chambers of an internal combustion engine.

8 Claims, 4 Drawing Figures

AIR-FUEL MIXTURE SUPPLY DEVICE OF INTERNAL COMBUSTION ENGINE

This invention relates to an air-fuel mixture supply device for supplying the mixture into the combustion chambers of an internal combustion engine.

Air-fuel mixture supply devices of the type wherein a fuel discharge nozzle is located upstream of the intake valve of an internal combustion engine, such as a carburetor, are designed to prepare fuel mist and discharge it into the stream of air flowing through the air-fuel mixture induction passage of the carburetor by effect of the vacuum generated within the venturi portion of the carburetor. The magnitude of the venturi vacuum depends on the flow rate of air passing through the venturi portion. The flow of air through the venturi portion is generated during the intake stroke of the engine and accordingly the flow of air is not continuous but intermittent. This intermittent air flow results in the phenomenon wherein a high air flow rate is provided to the venturi portion during the intake stroke, whereas an extremely low air flow rate due to only inertia of flowing air is provided during other than the intake stroke. Thus, the air flow rate through the venturi portion is always varied and consequently the venturi vacuum is also always varied causing the variation of the amount of the fuel discharged from the discharge nozzle opened to the venturi portion of the carburetor.

As mentioned above, the momentary amount of discharged fuel is always varied dependent on the pulsation of intake vacuum. It is known that the atomization of fuel discharged from the fuel discharge nozzle is made better as the frequency of the variation of the fuel discharge amount is higher, which results from the fact that if the frequency of the fuel discharge amount is lower and the cycle of variation is longer, the fuel discharged from the fuel discharge nozzle may flow along the inner wall surface of the air-fuel mixture induction passage of the carburetor without good atomization of the fuel. Accordingly, when the engine speed is higher and the cycle of variation of fuel discharge amount is shorter, the atomization of the fuel is better. On the contrary, the atomization of the fuel is deteriorated when the engine speed is lower and the cycle of variation of the fuel discharge amount is longer. This deterioration of the fuel atomization causes unsatisfied combustion condition of the fuel within the combustion chambers, which leads to unstable operation of the engine and failed exhaust gas control.

It is, therefore, a principal object of the present invention to provide an improved air-fuel mixture supply device for an internal combustion engine, capable of allowing the stable operation of the engine and improving the exhaust gas control.

Another object of the present invention is to provide an improved air-fuel mixture supply device of an internal combustion engine, capable of improving the combustion condition of fuel within the combustion chambers of the engine, particularly during idling condition of the engine.

Still another object of the present invention is to provide an improved carburetor capable of promoting atomization of the fuel discharged through the main discharge nozzle into the air-fuel mixture induction passage of the carburetor.

A further object of the present invention is to provide an improved carburetor in which the fuel passing through the main discharge nozzle is positively vibrated or caused to pulsate to effectively atomize the fuel discharged into the air-fuel mixture induction passage of the carburetor.

Other objects and features of the improved air-fuel mixture supply device in accordance with the present invention will become more apparent from the following description with reference to accompanying drawings, in which.

Figure 1:
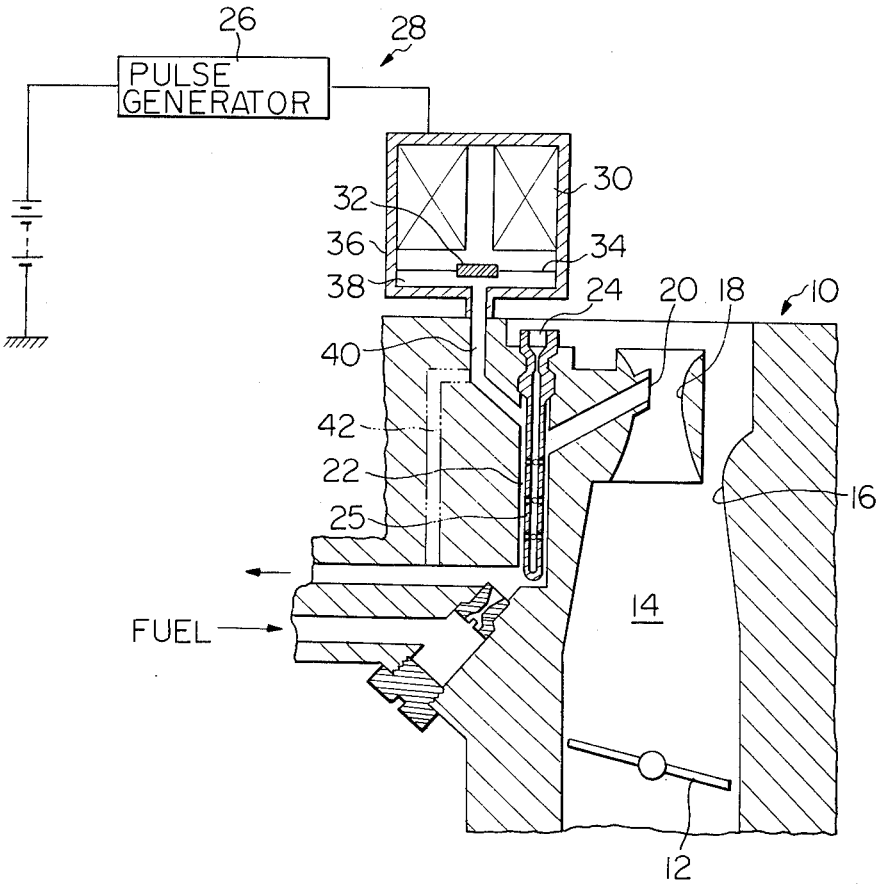
FIG. 1 is a schematic section view of a preferred embodiment of an air-fuel mixture supply device according to the present invention.

Referring now to FIG. 1, there is shown a preferred embodiment of a carburetor or air-fuel mixture supply device for use in an internal combustion engine (not shown), in accordance with the present invention which is generally designated by a reference numeral 10. The carburetor 10 has, as usual, a throttle valve which is rotatably disposed within the air-fuel mixture induction passage 14 thereof. The passage 14 is communicable with the combustion chamber or chambers (not shown) of the engine. A main venturi portion 16 is formed upstream of the throttle valve 12 and a secondary venturi portion 18 is formed adjacent the main venturi portion 16. Opened to the secondary venturi portion 18 is a main discharge nozzle 20 which forms part of a main circuit of the carburetor. The main discharge nozzle 20 is communicated with a main well 22 having a main air bleed 24 for inducting the atmospheric air into the main well 22 therethrough. The main well 22 is, as customary, communicated through a main jet (no numeral) with a float bowl (not shown) of the carburetor 10. Disposed within the main well 22 is an emulsion tube 25 secured to the main air bleed 24.

A pulse generator 26 forming part of vibrating means 28 is arranged to generate an electrical pulse signal having a predetermined frequency which pulse signal includes an energizing signal and a de-energizing signal, and electrically connected to an electromagnetic coil 30. The frequency of the pulse signal may be varied within a range. The electromagnetic coil 30 is arranged to be energized upon receiving the energizing signal of the pulse signal from the pulse generator 26, whereas be de-energized upon receiving the de-energizing signal of the pulse signal from the pulse generator 26. Disposed adjacent to the electromagnetic coil 30 is a vibrating member 32 made of a material capable of being affected by the magnetism of the coil 30. The vibrating member 32 is secured to the central portion of a diaphragm 34 which sealingly covers the inner bottom portion of a casing 36 and defining therebetween a pulsation chamber 38. Accordingly, the vibrating member 34 is arranged to be attracted to the electromagnetic coil 30 and moved in the direction to increase the volume of the pulsation chamber 38 when the electromagnetic coil 30 is energized, whereas be freed from the magnetism and moved in the opposite direction to decrease the volume of the pulsation chamber 38 when the electromagnetic coil 30 is de-energized. As shown, the pulsation chamber 38 is communicated with the upper portion of the main well 22 through a pulsation transmitting passage 40 formed through the body casting portion of the carburetor 10. The passage 40 may be further communicated with a fuel passage (no numeral) communicated with the bottom portion of the main well 22 through a passage 42 shown in broken lines in the figure.

With the arrangement hereinbefore described, during the pulse signal having a predetermined frequency, e.g. 60 Hz, is applied from the pulse generator 26, the electromagnetic coil 30 forces the vibrating member 32 to vibrate at the frequency corresponding to the predetermined frequency of the pulse signal causing the change of the volume of the pulsation chamber 38. When, the energizing signal of the pulse signal is applied to the electromagnetic coil 30, the diaphragm 34 is moved in the direction to increase the volume of the pulsation chamber 38 allowing the fuel in the main well 22 to move toward the pulsation chamber 38. Then, air is inducted into the main well 22 through the main air bleed 24 and the emulsion tube 25 to be well mixed with the fuel and emulsified with the fuel. On the contrary, when the de-energizing signal of the pulse signal is applied to the electromagnetic coil 30, the diaphragm 34 is moved in the opposite direction to decrease the volume of the pulsation chamber 38 allowing the fuel toward the pulsation chamber 38 to return into the main well 22. As discussed above, the fuel in the main well 22 is vibrated and therefore the fuel discharged from the main discharge nozzle 20 is forced to effectively pulsate causing effective atomization of the fuel discharged through the secondary venturi portion 18 into the air-fuel mixture induction passage 14 of the carburetor 10.

Figure 2:
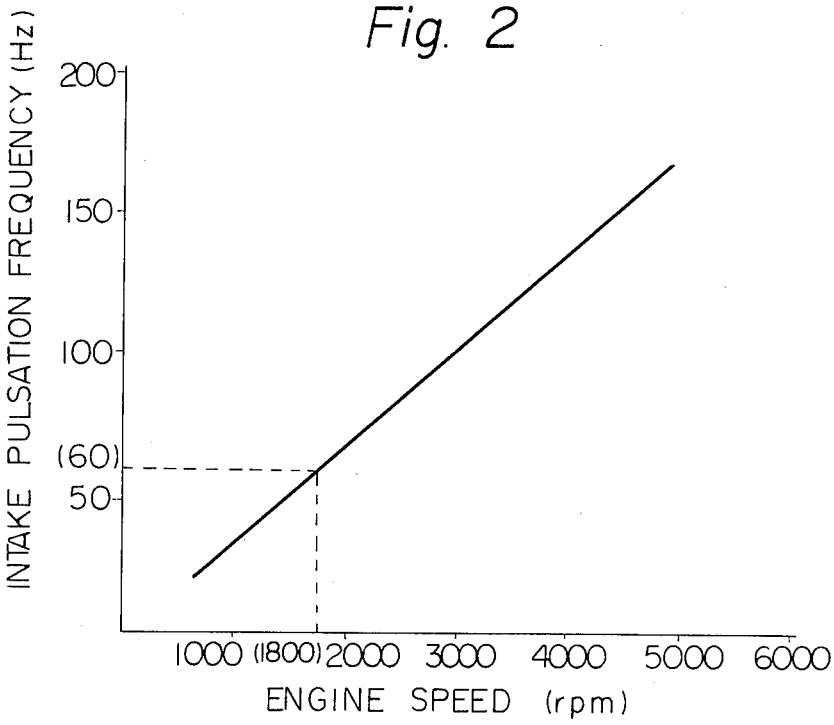
FIG. 2 is a graph showing an example of the relationship between the engine intake pulsation and the engine speed.

FIG. 2 shows an example of the relationship between the engine speed of an four-cylinder and four stroke cycle engine and the frequency of the intake pulsation generated within the air-fuel mixture induction passage 14 of the carburetor 10. This figure expresses that when the engine speed is about 1,800 rpm, the frequency of the pulsation within the air-fuel mixture induction passage 14 is about 60 Hz. Accordingly, if the frequency of the pulse signal generated by the pulse generator 26 is set at about 60 Hz as discussed above, the pulsation of the fuel discharged from the main discharge nozzle 20 is about 60 Hz and therefore the fuel atomization effect corresponding to an engine speed of about 1,800 rpm is obtained even when the engine speed is lower than 1,800 rpm. In view of the above, it is preferable to set the frequency of the pulse signal generated by the pulse generator 26 at at least 60 Hz in the four-cylinder and four stroke cycle engine for attaining the purpose of the invention. However, the frequency of about 40 Hz can also somewhat give the effect according to the present invention.

While only the vibrating means 28 which is applied to the main circuit is shown and described, the vibrating means may be applied to a low-speed circuit (not shown) of the carburetor 10 and arranged to operate the vibrating means only during idling of the engine. It will be understood that a variety of means for causing air or fuel to pulsate, such as an electromagnetic valve, may be employed in place of the pulsation generating mechanism with the diaphragm 34 of the vibrating means 28 of the instance shown in FIG. 1.

As is apparent from the foregoing discussion of the embodiment of FIG. 1, according to the present invention, the pulsation of the fuel passing through the main discharge nozzle 20 is positively generated and therefore the fuel discharged into the air-fuel mixture induction passage 14 of the carburetor is effectively atomized. This results in the stable operation of the engine and the improvement in exhaust gas control particularly during idling condition of the engine.

Figure 3:
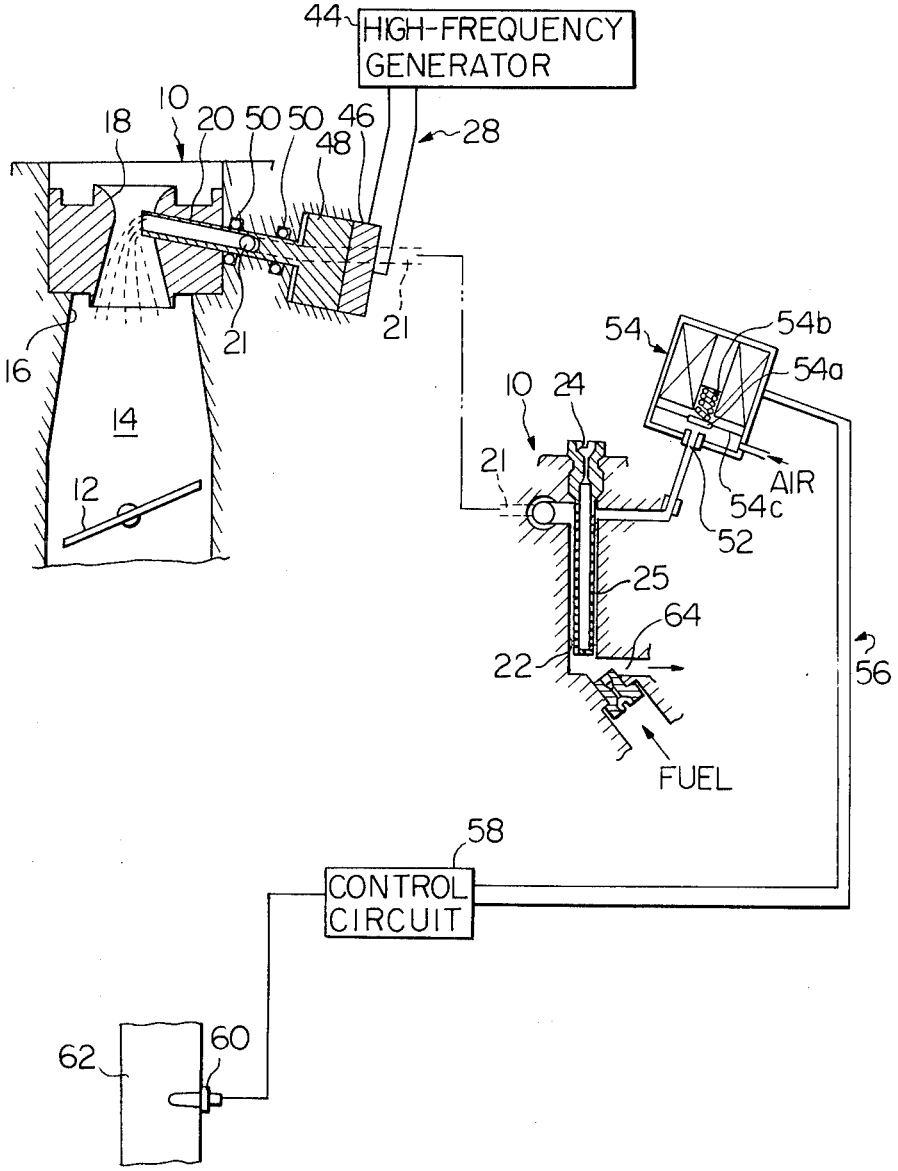
FIG. 3 is a schematical section view of another preferred embodiment of an air-fuel mixture supply device according to the present invention.

FIG. 3 illustrates another preferred embodiment of the carburetor 10 or the air-fuel mixture supply device in accordance with the present invention, in which parts similar to those of the embodiment of FIG. 1 have been omitted for the purpose of simplicity of illustration by designating the corresponding parts and elements at like reference numerals and characters.

First vibrating means 28 of this instance comprises a high-frequency generator 44 for generating an electrical signal having a high frequency. The high-frequency generator 44 is electrically connected to an electrostrictive vibrator 46 arranged to vibrate upon receiving the electrical signal from the high-frequency generator 44. A vibrating member 48 is secured to the vibrator 46 to be forced to vibrate with the vibrator 46 and operatively connected to the main discharge nozzle 20 to provide ultrasonic wave due to the vibration of the electrostrictive vibrator 46 to the fuel passing through the main discharge nozzle 20. As seen, the main discharge nozzle 20 in this instance is movably supported through circularly arranged ball bearings 50 surrounding the circumferential surface of the nozzle 20 by the body casting portion of the carburetor 10 in order to allow the main discharge nozzle 20 to vibrate freely relative to the body casting portion of the carburetor 10. With the arrangement of this first vibrating means 28, when the electrical signal having a high frequency is applied to the electrostrictive vibrator 46, the main discharge nozzle 20 is vibrated causing vibration due to the ultrasonic wave of the fuel passing through the main discharge nozzle 20. As a result, the fuel discharged from the main discharge nozzle 20 is effectively atomized and sprayed through the secondary venturi portion 18 into the air-fuel mixture induction passage 14 which is communicable with the combustion chambers (not shown) of the engine.

As illustrated, the main discharge nozzle 20 is communicated through a passage 21 with the main well 22. The main well 22 is equipped with an auxiliary air bleed 52 for inducting the atmospheric air into the main well 22 therethrough. Air-fuel mixture control means 56 comprises an electromagnetic valve 54 or air flow amount control means which is disposed, as shown, for opening or closing the auxiliary air bleed 52. The electromagnetic valve 54 is arranged to take a first state wherein the valve member **54*a* thereof is moved with respect to the auxiliary air bleed 52 to increase the flow amount of air inducted through the auxiliary air bleed 52, into the main well 22 than a predetermined level, whereas take a second state wherein the valve member 54*a* thereof is moved with respect to the auxiliary air bleed 52 to decrease the flow amount of the air inducted through the auxiliary air bleed 52 into the main well 22 than the predetermined level. It will be understood that when the electromagnetic coil (no numeral) of the electromagnetic valve 54 is energized, the valve member 54*a* is attracted to the coil to move in the direction to open the auxiliary air bleed 52, whereas when the coil of the electromagnetic valve 54 is de-energized, the valve member 54*a* is pushed by the action of a return spring 54*b* in the opposite direction to close the auxiliary air bleed 52**.

A control circuit 58 is electrically connected to the electromagnetic valve 54 and arranged to generate a first command signal for placing the electromagnetic valve 54 into the first state and a second command signal for placing the electromagnetic valve 54 into the second state. It is to be noted that each of the first and second command signals includes energizing signals and de-energizing signals respectively for energizing and de-energizing the coil of the electromagnetic valve 54 as discussed above. In this instance, the total time of the energizing signals of the first operating signal is arranged to be longer than that of the second operating signals for attaining the purpose of the invention. The control circuit 58 is electrically connected to an exhaust gas sensor 60 which is disposed within the exhaust passage 62 of the exhaust system of the engine. In this instance, the exhaust gas sensor 60 is an oxygen ($O_2$) sensor for detecting the concentration of $O_2$ contained in the exhaust gases discharged from the combustion chambers of the engine. The exhaust gas sensor 60 is arranged to generate a first information signal (which may be a voltage signal) for causing the control circuit 58 to generate the first command signal when the exhaust gases passing through the exhaust passage 62 have a first composition representing that the combustion chambers of the engine are fed with an air-fuel mixture richer than a predetermined level such as stoichiometric air-fuel ratio (14.8 : 1), and a second information signal for causing the control circuit 58 to generate the second command signal when the exhaust gases passing through the exhaust passage 62 have a second composition representing that the combustion chambers are fed with an air-fuel mixture leaner than the predetermined level. In order to operate the air-fuel ratio control means 56 in the above discussed manner, the control circuit may be arranged to set, as a reference voltage, a specified voltage signal from the exhaust gas sensor 60 generated when the predetermined level of the air-fuel mixture is supplied into the combustion chambers, and to generate the first command signal when the level of the voltage signal from the sensor 60 is lower than that of the specified voltage signal representing that the combustion chambers are fed with the air-fuel mixture leaner than the predetermined level and the second command signal when the level of the voltage signal from the sensor 60 is higher than that of the specified voltage signal representing that the combustion chambers are fed with the air-fuel mixture richer than the predetermined level. The exhaust gas sensor 60 may be a nitrogen oxides (NOx) sensor, a carbon monoxide (CO) sensor, a carbon dioxides ($CO_2$) sensor or a hydrocarbon (HC) sensor which are respectively detect the concentration of NOx, CO, $CO_2$ or HC contained in the exhaust gases discharged from the combustion chambers.

With the arrangement of this air-fuel ratio control means 56, when the combustion chambers of the engine are fed with the air-fuel mixture richer than the predetermined level such as stoichiometric air-fuel ratio, the electromagnetic valve 54 is operated to increase the flow amount of air inducted through the auxiliary air bleed 52 into the main well 22. Then, the flow amount of fuel through the main discharge nozzle 20 is decreased and accordingly the air-fuel mixture fed into the combustion chambers are made leaner. On the contrary, when the combustion chambers are fed with the air-fuel mixture leaner than the predetermined level, the electromagnetic valve 54 is operated to decrease the flow amount of air inducted through the auxiliary air bleed 52 into the main well 22. Then, the flow amount of fuel through the main discharge nozzle 20 is increased and accordingly the air-fuel mixture fed into the combustion chambers are enriched. As discussed above, the air-fuel mixture supplied into the combustion chambers can be always maintained accurately at the predetermined level such as the stoichiometric air-fuel ratio.

While only the electromagnetic valve 54 of the type wherein the air flow amount into the main well is controlled in on and off or intermittent manner are shown and described, it will be understood that means for controlling the air flow amount in a continuous manner may be used in place of the electromagnetic valve 54.

Figure 4:
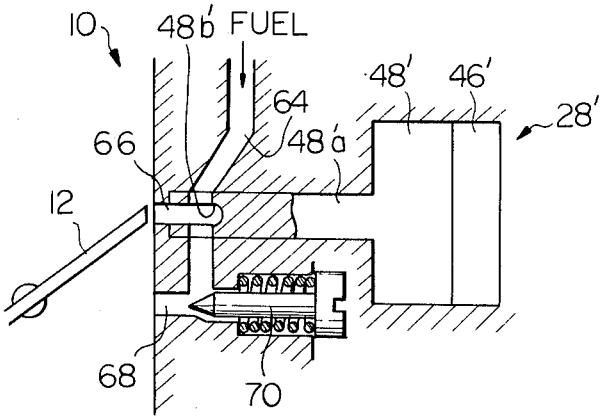
FIG. 4 is a schematical section view showing the low-speed circuit of the air-fuel mixture supply device of FIG. 3.

FIG. 4 shows the arrangement of second vibrating means 28' wherein an elongate portion **48*a'* of the vibrating member 48' secured to the electrostrictive vibrator 46' is extended through a fuel passage 64 of the low-speed circuit of the carburetor 10; the fuel passage 64 communicating the main well 22 (shown in FIG. 3) with a progression hole 66 which is opened to the air-fuel mixture induction passage 14 and placed on a level with the throttle valve 12 (at its fully closed position) and idle port 68 opened downstream of the progression hole 66. Disposed adjacent the idle port 68 is an idle adjustment screw 70 for adjusting the fuel flow through the idle port 68. The elongate portion 48*a'* of the vibrating member 48' has an opening 48*b'* passing through the elongate portion 48*a'*; the opening 48*b'* being arranged to be agreed with the fuel passage 64 of the low-speed circuit and progression hole 66. With the arrangement of the second vibrating means 28', when the electrical signal having a high-frequency is applied to the electrostrictive vibrator 46', the elongate portion 48*a'* of the vibrating member 48' is vibrated and therefore the fuel passing through the fuel passage 64 and the progression hole 66 is affected by the ultrasonic wave generated by the electrostrictive vibrator 46'. Consequently, the fuel discharged from the progression hole 66 and the idle port 68 is effectively atomized and sprayed into the air-fuel mixture induction passage 14 of the carburetor 10**.

It will be apparent from the foregoing explanation that, according to the embodiment of FIGS. 3 and 4, in addition to the advantage that the air-fuel ratio of the mixture fed into the combustion chambers is accurately maintained at a predetermined level by utilizing feedback techniques of the air-fuel ratio control means 56, the fuel passing through the main discharge nozzle 20 is vibrated by the effect of the ultrasonic wave generated by the electrostrictive vibrator 46 and consequently the fuel discharged from the main discharge nozzle 20 is effectively atomized and sprayed into the air-fuel mixture induction passage 14 of the carburetor 10. As a result of co-operation of the air-fuel mixture control means 56 and the vibrating means 28 including the electrostrictive vibrator 46, the combustion within the combustion chambers of the engine is improved and more stable operation of the engine is achieved as compared with an engine with a prior art carburetor. The improvement in the combustion results in the advantages in exhaust gas control wherein the emission levels of HC and CO are effectively decreased.

While only the carburetor 10 is shown and described as the air-fuel mixture supply device, it will be understood that the present invention may be applied to mechanically or electronically controlled fuel injection system for supplying air-fuel mixture into the combustion chambers of the engine.

What is claimed is:

1. An air-fuel mixture supply device for supplying an air-fuel mixture into the combustion chamber of an internal combustion engine, comprising:

a carburetor including a throttle valve, a main discharge nozzle forming part of a main circuit, opened to the venturi portion of said carburetor, a main well communicating with said main discharge nozzle and communicating with the float bowl of said carburetor, said main well having a main air bleed for inducting the atmospheric air into the main well therethrough, an auxiliary air bleed communicating with said main well for inducting the atmospheric air into said main well therethrough;

a fuel passage forming part of a low-speed circuit of said carburetor, communicating with the main well and having a progression hole which is opened to the air-fuel mixture induction passage of said carburetor and placed on a level with the throttle valve of said carburetor, and an idle port opened to the air-fuel mixture induction passage, first vibrating means for vibrating the fuel passing through said main discharge nozzle to effectively atomize the fuel supplied to the air-fuel mixture induction passage of said carburetor;

second vibrating means for vibrating the fuel passing through the fuel passage of the low-speed circuit to effectively atomize the fuel supplied the air-fuel mixture induction passage; and air-fuel ratio control means for controlling the air-fuel ratio of the air-fuel mixture in accordance with the composition of exhaust gases discharged from the combustion chamber of the engine, said air-fuel ratio control means including air flow amount control means for controlling the amount of air flow inducted through said auxiliary air bleed into the main well, said air flow amount control means being operated electrically and arranged to take a first state wherein the flow amount of the air is increased above a predetermined level and a second state wherein the flow amount of the air is decreased below said predetermined level, a control circuit electrically connected to said air flow amount control means and arranged to generate a first command signal to place said air flow amount control means into said first state and a second command signal to place said air flow amount control means into said second state, an exhaust gas sensor disposed within the exhaust gas passage of the exhaust system communicating downstream of the combustion chambers of the engine and electrically connected to said control circuit, said exhaust gas sensor being arranged to generate a first information signal for causing said control circuit to generate said first command signal when the exhaust gases passing through the exhaust passage have a first composition indicating that the combustion chambers are fed with an air-fuel mixture richer than a predetermined level, and a second information signal for causing said control circuit to generate said second command signal when the exhaust gases passing through the exhaust passage having a second composition indicating that the combustion chambers are fed with an air-fuel mixture leaner than the predetermined level.

2. A carburetor as claimed in claim 1, in which said first vibrating means is means for generating the pulsation of the fuel passing through the main discharge nozzle, said pulsation generating means including:

a pulse generator for generating an electrical pulse signal which includes an energizing signal and a de-energizing signal;

an electromagnetic coil arranged to be energized upon receiving the energizing signal of the pulse signal from said pulse generator and de-energized upon receiving the de-energizing signal of the pulse signal from said pulse generator;

a diaphragm defining a pulsation chamber which is communicated with said main well; and a vibrating member made of a material capable of being affected by the magnetism of said electromagnetic coil, secured to said diaphragm and arranged to be attracted to said electromagnetic coil to increase the volume of the pulsation chamber when the electromagnetic coil is energized and be freed from the magnetism and moved to decrease the volume of the pulsation chamber when the electromagnetic coil is de-energized.

3. A carburetor as claimed in claim 2, in which the engine is of four stroke cycle type and has four cylinders, said pulse generator being arranged to generate the pulse signal having a frequency of at least 40 Hz.

4. A carburetor as claimed in claim 3, in which the frequency is at least 60 Hz.

5. A carburetor as claimed in claim 1, in which said first vibrating means includes:

a high-frequency generator for generating an electrical signal having a high frequency;

an electrostrictive vibrator electrically connected to said high-frequency generator and arranged to be vibrated upon receiving the electrical signal from said high-frequency generator; and a vibrating member secured to said electrostrictive vibrator and operatively connect to the main discharge nozzle of the carburetor for vibrating the main dischage nozzle.

6. A carburetor as claimed in claim 1, said second vibrating means includes:

a high-frequency generator for generating an electrical signal having a high frequency;

an electrostrictive vibrator electrically connected to said high-frequency generator and arranged to be vibrated upon receiving the electrical signal from said high-frequency generator; and a vibrating member secured to said electrostrictive vibrator and having a passage disposed communicating with the fuel passage of the low speed circuit.

7. A spark-ignition internal combustion engine as claimed in claim 1, in which said air flow amount control means includes an electromagnetic valve having a valve member which is arranged to be moved with respect to the auxiliary air bleed to increase the flow amount of air inducted through the auxiliary air bleed into the main well than the predetermined level upon receiving the first command signal from the control circuit, and moved with respect to the auxiliary air bleed to decrease the flow amount of the same air than the predetermined level upon receiving the second command signal from said control circuit.

8. A carburetor as claimed in claim 5, in which said main discharge nozzle is supported through circularly arranged ball bearings surrounding the circumferential surface of the nozzle by the body casting portion of the carburetor.

* * * * *